United States Patent [19]

Halatek

[11] 4,077,460

[45] Mar. 7, 1978

[54] SAFETY SHIELD ASSEMBLY FOR CENTRIFUGAL CASTING APPARATUS

[76] Inventor: Richard J. Halatek, 2404 N. Cardinal Dr., Rolling Meadows, Ill. 60008

[21] Appl. No.: 722,413

[22] Filed: Sep. 13, 1976

[51] Int. Cl.[2] ..... B22D 13/00; B29C 5/04; F16P 1/02

[52] U.S. Cl. ..... 164/152; 74/609; 164/289; 425/151

[58] Field of Search ..... 164/153, 152, 286, 287, 164/288, 289, 293, 295, 114, 118; 74/608, 609, 611, 612, 613, 614, 615, 616; 192/135, 136; 425/151, 152, 263, 459; 249/137

[56] References Cited

U.S. PATENT DOCUMENTS

| | | | |
|---|---|---|---|
| 2,192,043 | 2/1940 | Hooper | 164/289 |
| 2,445,364 | 7/1948 | Rankin | 164/118 X |
| 2,509,670 | 5/1950 | Capita | 164/287 X |
| 2,618,031 | 11/1952 | Mazer | 164/293 X |
| 2,638,653 | 5/1953 | Adams | 425/459 X |
| 2,665,008 | 1/1954 | Call | 164/289 X |
| 2,749,585 | 6/1956 | Prosen | 164/287 X |
| 2,917,797 | 12/1959 | Pougnand | 164/287 X |

*Primary Examiner*—J. Howard Flint, Jr.
*Assistant Examiner*—John S. Brown

[57] ABSTRACT

The following specification describes a safety shield assembly for centrifugal casting apparatus of the type used by hobbyists. The assembly comprises a ring wall encircling the path of rotation of the casting arm carrying the metal charge and mold. A top wall is provided having a central opening through which access is provided for heating the metal and releasing the arm carrying the charge and mold for rotation. The top wall is provided with a fixed wall portion and a lid hingedly secured along a diameter line of the ring wall and foldable into coincident relationship with the fixed top wall portion.

An annular bottom wall adapted to be secured to a table top is also provided for the ring wall and a cup shaped housing adapted to be recessed in the table top is fixed to the bottom wall. The housing has a back wall for supporting the centrifugal casting apparatus with arms of the casting apparatus located just above the table top to reduce the height required of the ring wall.

The housing has a smaller diameter than the opening in the top wall so that a number of shields may be stacked with the housing of one shield received within a ring wall of another shield. The relatively short diameter housings supporting the casting apparatus and received in the table top provides greater rigidity and stability.

7 Claims, 5 Drawing Figures

SAFETY SHIELD ASSEMBLY FOR CENTRIFUGAL CASTING APPARATUS

BACKGROUND OF THE INVENTION

Field of the Invention

This invention relates in general to a safety shield assembly for centrifugal casting apparatus and more particularly to an improved and more economical safety shield assembly for centrifugal casting apparatus of the type used for casting small objects such as jewelry rings and/or the like.

Summary of the Prior Art

In the casting of small objects such as rings by jewelry and lapidary hobbyists, for example, a metal charge is deposited in a dish adjacent a mold carried by an arm of a portable spring wind up centrifuge. The metal is heated and when molten is whirled with the mold at relatively high speed to force the metal through one or more small mold sprues into the mold cavities. The back pressure and/or other factors such as a defective mold or excess charge often permits the molten metal and/or hot mold fragments to spray about the premises creating a hazard to personnel in the area and the danger of fire.

To avoid the hazards or dangers resulting from the hot metal spray, while preserving the portability and economy necessary for the hobbyist, it is customary to deposit the centrifuge apparatus in an open sheet metal wash tub commonly called a casting drum. The rim wall of the tub encircles the rotational path of the centrifuge arms to thereby provide some protection from flying metal.

The tub together with the housing of the centrifuge apparatus are usually placed on a table for convenience and the bottom wall of the tub together with the housing of the centrifuge apparatus are bolted or detachably secured in common to the table top.

The just described arrangement, however, still presents some difficulty, since the top of the tub is open permitting some metal spray and the height of the tub rim wall above the table interferes with convenient access to the metal and centrifugal apparatus, which is usually of a spring wind up type requiring release of a pin to enable the spring tension to initiate rotation of the centrifuge arms.

Attempts have recently been made to avoid the defects of the open wash tub by utilizing a hinged cover. The cover however has been hinged at a position offset from a diameter line of the tub and must open away from the table edge in order to facilitate access to the centrifugal apparatus and mold. The operator must therefore generally lean over the tub edge to reach and close the cover and simultaneously release the pin holding the centrifuge arm for rotation while heating the metal to ensure its molten condition. This requires considerable dexterity and renders the arrangement difficult to use without error in the molding operation.

In addition since the centrifuge apparatus housing is located on the upper surface of the table, the tub rim wall must still extend considerably above the table top in order to encompass the arms of the centrifuge. Reaching over the relatively high rim wall for heating, cover closing and pin release to permit arm rotation is difficult, while any tendency to lean against the tub rim wall permits the wall to deform relatively easily and interfere with the rotational movement of the arms.

SUMMARY OF THE INVENTION

The present invention provides several simple but ingenious solutions for the problems set forth above while still maintaining the economy and portability of the prior arrangements. Thus the present invention utilizes a shield or guard assembly including a rim wall with cover or top wall having a central opening spaced radially inwardly of the metal charge and mold during rotation and generally coaxial with the shaft of the centrifuge apparatus to permit both facile heating of the metal to ensure its molten state, and facile release of the centrifuge arms for rotation without requiring the simultaneous manipulation of the cover.

The cover is formed in two portions with one portion fixed to the rim wall and the other portion hingedly secured to the fixed portion along a diameter line of the rim wall so that it may be folded or opened into coincident relationship with the fixed portion to provide access to the centrifuge apparatus for such purposes as winding the centrifuge spring, mold placement and the deposit of a metal charge, for example.

A bottom wall is also provided for the rim wall and the bottom wall supports a cup shaped housing projecting from the bottom wall. The cup shaped housing is aligned with the central opening in the top wall and is dimensioned for facile recessing in the table top and for carrying the centrifugal apparatus. The centrifuge arms are thus lowered relative the top surface of the table to a position just above the table top. The rim wall of the shield or tub can therefore also be reduced permitting more facile access to the centrifuge apparatus. The cup shaped housing being of substantially smaller dimension or diameter than the shield or rim wall is of course relatively more rigid and stable and since it is additionally supported by the table top wall, the entire assembly is rendered more stable and rigid. With the centrifuge apparatus more rigidly supported by recessing in the table top, the outer or rim wall of the tub can be allowed to project over the table top edge, if desired, to further facilitate access to the apparatus since the operator can move about a greater circumferential arc of the shield or rim wall.

The diameter of the cup shaped housing on the bottom wall of the shield assembly is selected as somewhat smaller than the diameter of the central opening of the cover. This permits each cup shaped housing to be nestingly received in the cover of a lower shield with the bottom wall of the upper housing resting upon the cover of the lower housing to thereby form a stable stack for transport or shipment.

It is therefore one object of the present invention to provide an improved and/or more stable, economical safety shield assembly for use with centrifugal casting apparatus of the type used by hobbyists for casting small objects.

It is another object of the present invention to provide a safety assembly having improved access to manually releaseable centrifugal casting apparatus housed by the safety assembly.

It is still another object of the present invention to provide an economical portable safety assembly having improved stability and/or rigidity for use with portable centrifugal casting apparatus.

Other objects together with the features of the present invention will become apparent on examination of the following specification and claims together with the accompanying drawings.

DESCRIPTION OF THE PREFERRED EMBODIMENT

Figure 1:
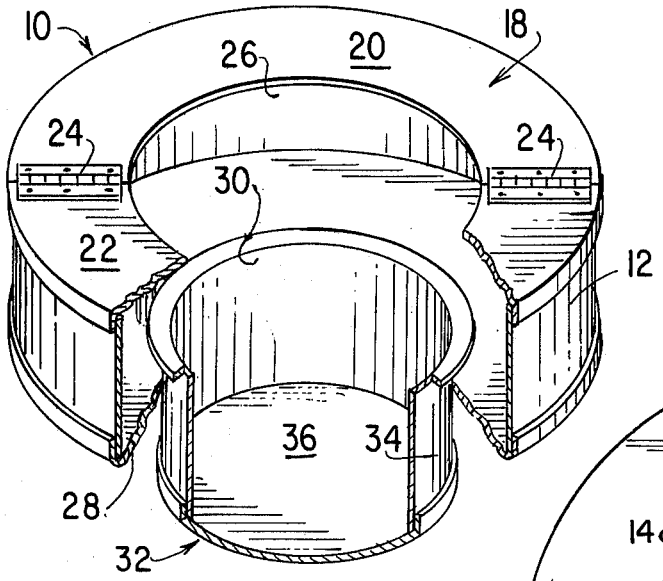
FIG. 1 is a partially broken away perspective view illustrating a safety shield assembly employing the principles of the present invention.

In FIG. 1 a guard or safety shield assembly employing the principles of the present invention is indicated generally by the reference character 10. The shield assembly 10 is a casting drum formed of sheet metal and includes a first annular rim or shield wall 12 having a diameter of substantially 26 to 27 inches and large enough to encompass or encircle the rotational path of arms 14 and **14*a* of a conventional portable spring wind up centrifugal casting apparatus 16** indicated in FIG 3.

Figure 4:
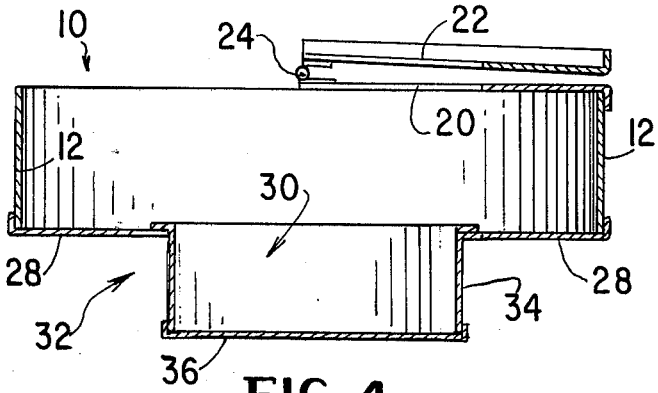
FIG. 4 is a sectional view illustrating the assembly shown in FIGS. 1 and 2 with the lid open.
Figure 5:
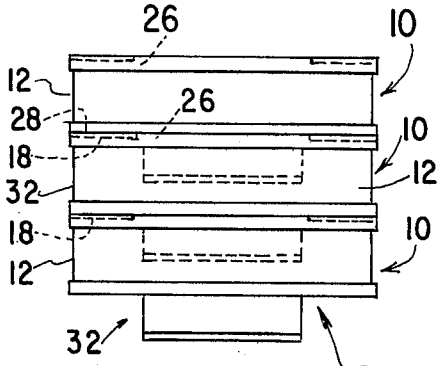
FIG. 5 illustrates a plurality of the shield assemblies shown in FIGS. 1–4 arranged in a stack for transport.

The shield wall 12 is provided at one axial end with a cover or top annular wall 18, which is fabricated in two halves from substantially semiannular wall portions 20 and 22 each having a lip overlappingly engaging the annular shield wall 12. The lip on portion 20 serves to secure portion 20 to the ring wall 12 by either welding or riveting, for example, and the portion 22 is secured in turn to portion 20 by means of spaced hinges 24 arranged along a diameter line of the wall 12. The portion 22 thus serves as a lid for enabling access to the interior wall 12. The lid 22 can thus be easily opened into generally coincident relationship with portion 20 as indicated in FIG. 4 to thereby occupy a minimum of space, and be easily reached for closing. The wall portion 20 and lid 22 define a central opening 26 of substantially 13 inches diameter and spaced radially inwardly of the end of arms 14 and **14*a* and generally coincident with the axis of rotation of the arms 14 and 14*a* to provide access to the centrifugal apparatus 16 with the lid 22** in closed position.

The shield wall 12 is also provided at its other axial end with a back or bottom wall 28 having a lip overlappingly secured to the ring wall 12 by riveting or welding, for example, and a central opening 30 is provided in the back wall or support means 28 coaxial with opening 26 to define the open end of a cup shaped member or housing 32 and permitting communication with housing 32.

It will be understood of course that the walls of shield assembly 10 may be secured together by any technique in addition to welding or riveting such as by conventional sheet metal seams. It will also be noted that the hinges 24 extend substantially between the inner and outer edges of portions 20 and 22 to cover the space or juncture therebetween.

The housing 32 comprises a ring or rim wall means 34 generally coaxial with wall 12 with a diameter of approximately 12 inches so that it is of smaller diameter than the opening 26. Annularly shaped wall means 34 is secured at one axial end to bottom wall 28 and the other axial end of wall 34 is secured to a circular mounting wall 36 having a corresponding diameter for supporting the housing 38 of the conventional wind up type centrifugal casting apparatus 16. Such apparatus may typically be of the type noted as Vigor in catalog BK-122 published by B. Jadow & Sons, Inc., 53 W. 23rd Street, New York, New York, or manufactured by such companies as Kerr, 2820 Wick Rd., Romulus, Michigan and shown in a catalog of United Abrasives, 910 Brown St., Norway, Michigan, or manufactured by Hammil and Ridglander.

Figure 3:
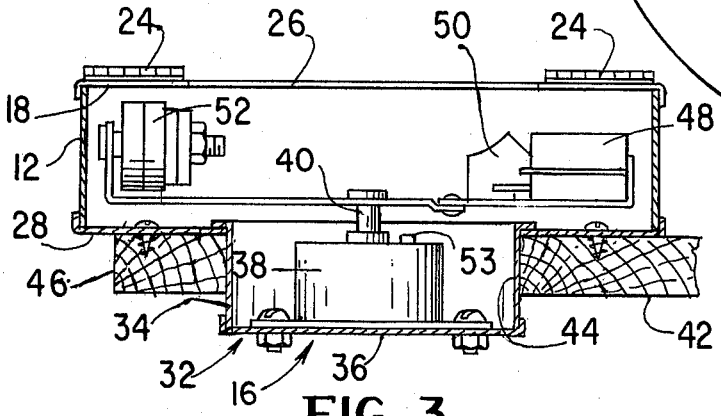
FIG. 3 is a sectional view illustrating the assembly shown in FIGS. 1 and 2 with the casting apparatus arms in rotational position.

The housing 38 of the apparatus 16 carries the conventional wind up spring for rotating a shaft 40 connected to the arms 14 and **14*a* and is detatchably secured to the back or bottom mounting wall 36 of housing 32 by means of screws or bolts extending through flange means on housing 38 as indicated in FIG. 3**.

Preferably the shield 10 is mounted on a table top 42 by providing an opening 44 in the table top having a diameter substantially the same as wall 34 of housing 32 for nestingly receiving the wall 34. The opening 44 is located relative an edge of the table so the wall 12 may extend partially over or beyond the table top edge 46 or several table edges. This enables the operator to move about a considerable circumferential arc of the shield assembly for any purpose required in the operation of the casting apparatus. The wall of the table top and relatively short bottom mounting wall 36 rigidify and stabilize the assembly. In addition by detatchably securing the bottom wall 28 to the table top by screws or bolts spaced radially outwardly of the centrifuge apparatus housing 38 the assembly is further stabilized and rigidified against forces generated during operation of the casting apparatus or by leaning against the wall 12.

The mounting wall 36 supports the casting apparatus at a position extending from below the top surface of the table top 42 so that the arms 14 and **14*a* which are approximately 7 inches above wall 36 are located adjacent wall 28 and between walls 18 and 28. This permits the height or axial length of the shield wall 12 to be reduced to substantially 8 inches and wall 34 to 5 inches for both facilitating access to the centrifugal apparatus and for reducing bending moments on the wall 12** in the event some one leans thereagainst.

Figure 2:
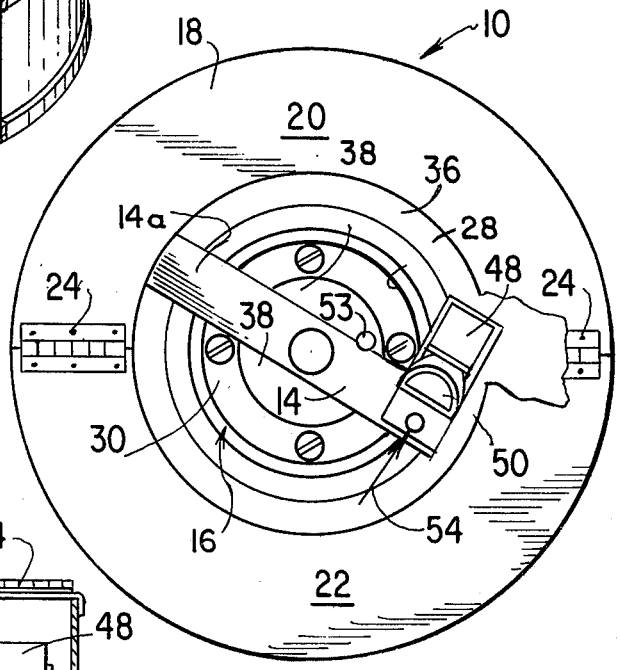
FIG. 2 is a top elevational view of the assembly shown in FIG. 1 showing a typical centrifuge casting apparatus.

One arm 14 of the casting apparatus is formed in two sections with a radial outward section pivotally connected to the radial inward section and normally positioned transverse to the diameter line extending through arm **14*a*, when the casting apparatus is unoperated, as shown in FIG. 2. The transverse section of arm 14 receives a conventional mold held in a metal ring and a dish 5 is located radially inwardly of the mold 48. A charge such as metal shot is deposited in the dish 50 and heated to a molten condition. Thereafter during rotation of the arm 14, the molten metal is delivered through a conventional conduit or orfice connecting the dish and mold to the mold cavities. The other arm 14*a* of the casting apparatus carries adjustable counter weights 52** for balancing the arms, dish, metal and mold during their rotation.

The mold 48 may contain as many as eight or nine mold cavities, for example, for forming jewelry rings by the lost wax method. Each cavity receives the molten metal through a relatively small passageway or sprue extending to the conduit connecting the dish and mold. The small passageways or excess metal may create considerable pressure during the rotation of the arms 14 and **14*a*** and together with any defect in the mold contributes to the requirements of the safety assembly of the subject invention, as the radial outward end or bottom end of the mold may fracture and permit the metal to spray.

In preparation for casting the lid 22 is open as shown in FIG. 4 for convenient access and the radial outward section of arm 14 is at substantially a right angle or transverse to the diameter line extending through arm 14*a*. The spring in the housing of the casting apparatus is tensed by manually rotating arms 14 and 14*a* in a clockwise direction as seen in FIG. 2. When tensed, a pin 53 is lifted from the housing of the casting apparatus and the pin 53 bears against the radial inward section of arm 14 and/or may partially overlap the arm. Pin 53 prevents rotation of the arms 14 and 14*a* under the influence of the spring.

The metal shot or charge in dish 50 is now conveniently heated by a torch manually held in one hand, for example. Mold 48 which usually heated to substantially 1200° F. is then fixed to the radial outward end of arm 14.

The lid or cover portion 22 is then closed through the torch flame, which is applied with one hand, while the other hand is free, as soon as the lid is closed. The flame is maintained through the central opening 26, as indicated by the arrow 54, to ensure the molten condition. When it appears that the metal is in the desired molten condition, the spring tension is conveniently released by extending the free hand through the opening 26 to rotate the arms 14 and 14*a* slightly past their tensed position while the flame is maintained with the other hand. Movement of the arms allows the pin 53 to drop back into the housing and now when the operator releases the arms, and simultaneously withdraws the torch, the spring rotates the arms in the counter clockwise direction as seen in FIG. 2.

The release operation or control of the arms and casting apparatus is thus carried out through the central opening 26 with one hand while the other hand holds the torch, since the lid or cover portion 22 has already been closed and there is no need to reach over the casting apparatus to close the same.

The initiation of rotation flings the transverse section of arm 14 into colinear position relative arm 14*a* and the radial inward section of arm 14, as shown in FIG. 3 to create centrifugal pressure on the molten metal to drive the same into the mold passageways and cavities for filling the cavities completely and rotation continues until the spring tension is sufficiently dissipated. Any molten metal or hot metal discharged from the dish 50 without entering the mold or as a result of mold fracture or cracking due, for example, to moisture content, will of course tend to fly radially outwardly, since it is usually the radial outward or back end of the mold which gives. The sprayed metal encounters the shield wall 12 and if any metal rebounds therefrom it of course strikes the top wall 18 and falls to the bottom wall 28 so that discharge of any molten metal from the confines to the shield 10 is prevented since the opening 26 is spaced radially inwardly of the rotational path of mold 48 during rotation.

FIG. 4 illustrates a plurality of shields 10 arranged in a stack 56 for shipping or transport. In the stack 56 a central opening 26 of one shield 10 receives the cup shaped housing 32 of the shield immediately above since the openings 28 have a slightly greater diameter than the walls 34 of housing 32 and the housing 32 is shorter than wall 12. The bottom wall 28 of the upper shield simply rests on the cover wall 18 of the lower shield 10 to thereby provide a compact easily transportable stack.

The foregoing constitutes a description of an improved safety shield assembly for use in centrifugal casting of small objects and although designed primarily for hobbyists it is believed capable of adaption for other types of casting such as dental. The inventive concepts are not believed limited by the specific embodiment disclosed, but therefore are believed set forth in the accompanying claims.

I claim:

1. For use in a table top a safety shield assembly encircling the rotational path of an arm driven by centrifugal casting apparatus and carrying a mold adapted to receive a charge of molten metal from a dish carried by said arm at a position spaced radially inwardly of said mold in response to the rotation of said mold, dish and metal along said path, the improvement comprising:

a shield wall encircling the rotational path of said arm carrying said mold, dish and metal, a cover wall on said shield wall having a cover wall opening for enabling the manual application of heat to said charge and the manual control of said casting apparatus for rotating said arm, said cover wall including a wall portion fixed to said shield wall, and a lid pivotally attached to said wall portion adjacent a diameter line of said ring wall and pivotable into a generally coincident relationship with said fixed wall portion, support means secured to said shield wall and located at an axial position spaced from said cover wall to define a bottom opening substantially coincident with said cover wall opening, and a cup shaped housing secured to said support means with said cup shaped housing having an open end communicating with said bottom opening and a mounting wall spaced from said open end for supporting said centrifugal apparatus.

2. The shield assembly claimed in claim 1 in which said housing includes an annularly shaped wall means of smaller diameter than said shield wall for receipt in said table top and said mounting wall is fixed to said annular wall and located at a position spaced axially from said support means.

3. The shield assembly claimed in claim 1 in which said mounting wall is of substantially smaller diameter than said shield wall.

4. The shield assembly claimed in claim 2 in which said shield wall is adapted to overlap the edge of said table top in response to the receipt of said annularly shaped wall means in said table top.

5. The shield assembly claimed in claim 2 in which said support means is adapted to be secured to said table top at a position spaced radially outwardly of said annularly shaped wall means.

6. For use with a table top a safety shield assembly encircling the rotational path of an arm driven by centrifugal casting apparatus of the spring wind up type having a manually operable pin adjacent the axis of rotation of said path for enabling the rotation of said apparatus and carrying a mold adapted to receive a charge of molten metal from a dish carried by said arm at a position spaced radially inwardly of said mold in response to the rotation of said mold, dish and metal along said path, the improvement comprising:

an annularly shaped shield wall encircling the rotational path of said arm carrying said mold, dish and metal, a semi annularly shaped cover wall secured to said shield wall and extending radially inwardly of said shield wall toward said axis of rotation for overlaping said arm, a semi annularly shaped lid, means pivotally supporting said lid on said cover wall for movement into a position overlapping said semi annularly shaped cover wall to define a first large opening enabling facile deposit of said mold and dish on said arm and for movement into substantially coplanar relationship with said cover wall and extending radially inwardly of said annular wall to define a second smaller opening coincident with said axis of rotation for enabling the manual application of heat to said charge and the simultaneous manual operation of said casting apparatus pin through said second opening for enabling rotating said arm, an annular bottom wall for said shield wall spaced axially from said cover wall with said arm spaced intermediate said cover wall and said bottom wall, the annular bottom wall defining an opening enabling manual access therethrough, and a housing projecting from said bottom wall for receipt in said table top with said housing adapted to carry said casting apparatus and accessible through the opening defined by said annular bottom wall.

7. For use in a table top a safety shield assembly encircling the rotational path of an arm driven by centrifugal casting apparatus and carrying a mold adapted to receive a charge of molten metal from a dish carried by said arm at a position spaced radially inwardly of said mold in response to the rotation of said mold, dish and metal along said path, the improvement comprising:

a shield wall encircling the rotational path of said arm carrying said mold, dish and metal, a cover wall on said shield wall having a cover wall opening for enabling the manual application of heat to said charge and the manual control of said casting apparatus for rotating said arm, an annular bottom wall for said shield wall spaced axially from said cover wall with said arm spaced intermediate said cover wall and said bottom wall, a housing projecting from said bottom wall for receipt in said table top with said housing adapted to carry said casting apparatus, said housing has a smaller diameter than said cover wall opening to enable the housing of one shield assembly to be received in the cover wall opening of another shield assembly with the bottom wall of said one shield assembly supported by the top cover wall of the other shield assembly.

* * * * *